US009411315B2

(12) United States Patent
Sawada

(10) Patent No.: US 9,411,315 B2
(45) Date of Patent: Aug. 9, 2016

(54) ELECTRONIC DEVICE AND WRISTWATCH

(71) Applicant: CASIO COMPUTER CO., LTD., Shibuya-ku, Tokyo (JP)

(72) Inventor: Makoto Sawada, Nishi-Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/613,184

(22) Filed: Feb. 3, 2015

(65) Prior Publication Data

US 2015/0268636 A1 Sep. 24, 2015

(30) Foreign Application Priority Data

Mar. 18, 2014 (JP) ..... 2014-055112

(51) Int. Cl.

| | |
|---|---|
| ***G04G 21/04*** | (2013.01) |
| ***G04G 13/02*** | (2006.01) |
| ***G04B 19/06*** | (2006.01) |
| ***G04R 20/02*** | (2013.01) |
| ***G04R 60/10*** | (2013.01) |
| ***G04R 20/08*** | (2013.01) |

(52) U.S. Cl.

CPC ..... *G04B 19/065* (2013.01); *G04R 20/02* (2013.01); *G04R 20/08* (2013.01); *G04R 60/10* (2013.01)

(58) Field of Classification Search

CPC ..... G04R 20/00; G04R 20/02; G04R 20/04; G04R 20/08; G04R 20/10; G04R 20/16; G04R 20/22; G04R 20/26; G04R 60/10; G04B 19/065; G04G 21/04

See application file for complete search history.

(56) References Cited

U.S. PATENT DOCUMENTS

| | | | | |
|---|---|---|---|---|
| 5,627,548 | A * | 5/1997 | Woo | G01S 19/34 342/352 |
| 5,663,735 | A * | 9/1997 | Eshenbach | G01S 19/235 342/357.62 |
| 6,288,977 | B1 * | 9/2001 | Yoshida | G04G 5/002 368/187 |
| 6,299,345 | B1 * | 10/2001 | Burnette | G04F 10/00 273/237 |
| 8,467,272 | B2 | 6/2013 | Fujisawa | |

(Continued)

FOREIGN PATENT DOCUMENTS

| | | | |
|---|---|---|---|
| JP | 2007256159 | A | 10/2007 |
| JP | 2011075541 | A | 4/2011 |

OTHER PUBLICATIONS

Japanese Office Action (and English translation thereof) dated Feb. 4, 2016, issued in counterpart Japanese Application No. 2014-055112.

*Primary Examiner* — Amy Cohen Johnson
*Assistant Examiner* — Matthew Powell
(74) *Attorney, Agent, or Firm* — Holtz, Holtz & Volek PC

(57) ABSTRACT

The present invention includes a wristwatch case provided with a watch glass, a dial plate provided in the wristwatch case, and a timepiece module arranged below the dial plate, and the timepiece module has a first antenna arranged in its one end portion so as to receive a high-frequency radio wave for GPS and a second antenna arranged in the other end portion opposing the first antenna so as to receive a standard time radio wave whose frequency differs from that of a radio wave to be received by the first antenna. Accordingly, radio waves for GPS can be received by the first antenna and standard time radio waves can be received by the second antenna arranged opposing the first antenna.

23 Claims, 12 Drawing Sheets

(56) References Cited

U.S. PATENT DOCUMENTS

| | | | | |
|---|---|---|---|---|
| 8,755,253 | B2 | 6/2014 | Fujisawa | |
| 8,942,068 | B2 | 1/2015 | Fujisawa | |
| 9,116,512 | B2 | 8/2015 | Fujisawa | |
| 2004/0233789 | A1* | 11/2004 | Oguchi | G04C 3/008 368/47 |
| 2006/0023572 | A1* | 2/2006 | Someya | G04C 9/02 368/47 |
| 2007/0201313 | A1* | 8/2007 | Rudolph | G04G 5/002 368/47 |
| 2008/0030403 | A1* | 2/2008 | Honda | G01S 19/14 342/357.52 |
| 2010/0124151 | A1* | 5/2010 | Someya | H01Q 9/04 368/47 |
| 2010/0144300 | A1* | 6/2010 | Someya | H01Q 1/273 455/233.1 |
| 2011/0051561 | A1 | 3/2011 | Fujisawa | |
| 2012/0092822 | A1* | 4/2012 | Mooring | G04G 17/04 361/679.21 |
| 2013/0235703 | A1* | 9/2013 | Fujisawa | G04G 5/002 368/28 |
| 2014/0022871 | A1 | 1/2014 | Fujisawa | |
| 2014/0233358 | A1 | 8/2014 | Fujisawa | |
| 2015/0092521 | A1 | 4/2015 | Fujisawa | |
| 2015/0323907 | A1 | 11/2015 | Fujisawa | |

* cited by examiner

ELECTRONIC DEVICE AND WRISTWATCH

CROSS-REFERENCE TO RELATED APPLICATION

This application is based upon and claims the benefit of priority from the prior Japanese Patent Application No. 2014-055112, filed Mar. 18, 2014, the entire contents of which is incorporated herein by reference.

BACKGROUND OF THE INVENTION

1. Field of the Invention

The present invention relates to an electronic device such as a wristwatch, a mobile phone, and a portable information terminal device and a wristwatch.

2. Description of the Related Art

For example, Japanese Patent Application Laid-Open (Kokai) Publication No. 2007-256159 discloses a wristwatch structured such that a first antenna and a second antenna having different inductances are provided in a wristwatch case and receive a standard time radio wave.

With this wristwatch, one type of radio wave, such as a standard time radio wave, can be stably received. However, this wristwatch is not capable of, for example, receiving both a GPS (Global Positioning System) radio wave and a standard time radio wave.

An object of the present invention is to provide an electronic device that favorably receives radio waves of different frequencies.

SUMMARY OF THE INVENTION

In accordance with one aspect of the present invention, there is provided an electronic device comprising: a case; a dial plate provided in the case; and a module arranged below the dial plate, wherein the module includes a first antenna arranged in an end portion, and a second antenna arranged in an other end portion opposing the first antenna so as to receive a radio wave having a frequency differing from a frequency of a radio wave to be received by the first antenna.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

First Embodiment

Hereinafter, a first embodiment where the present invention has been applied in a pointer type wristwatch will be described with reference to FIG. 1 to FIG. 6.

Figure 1:
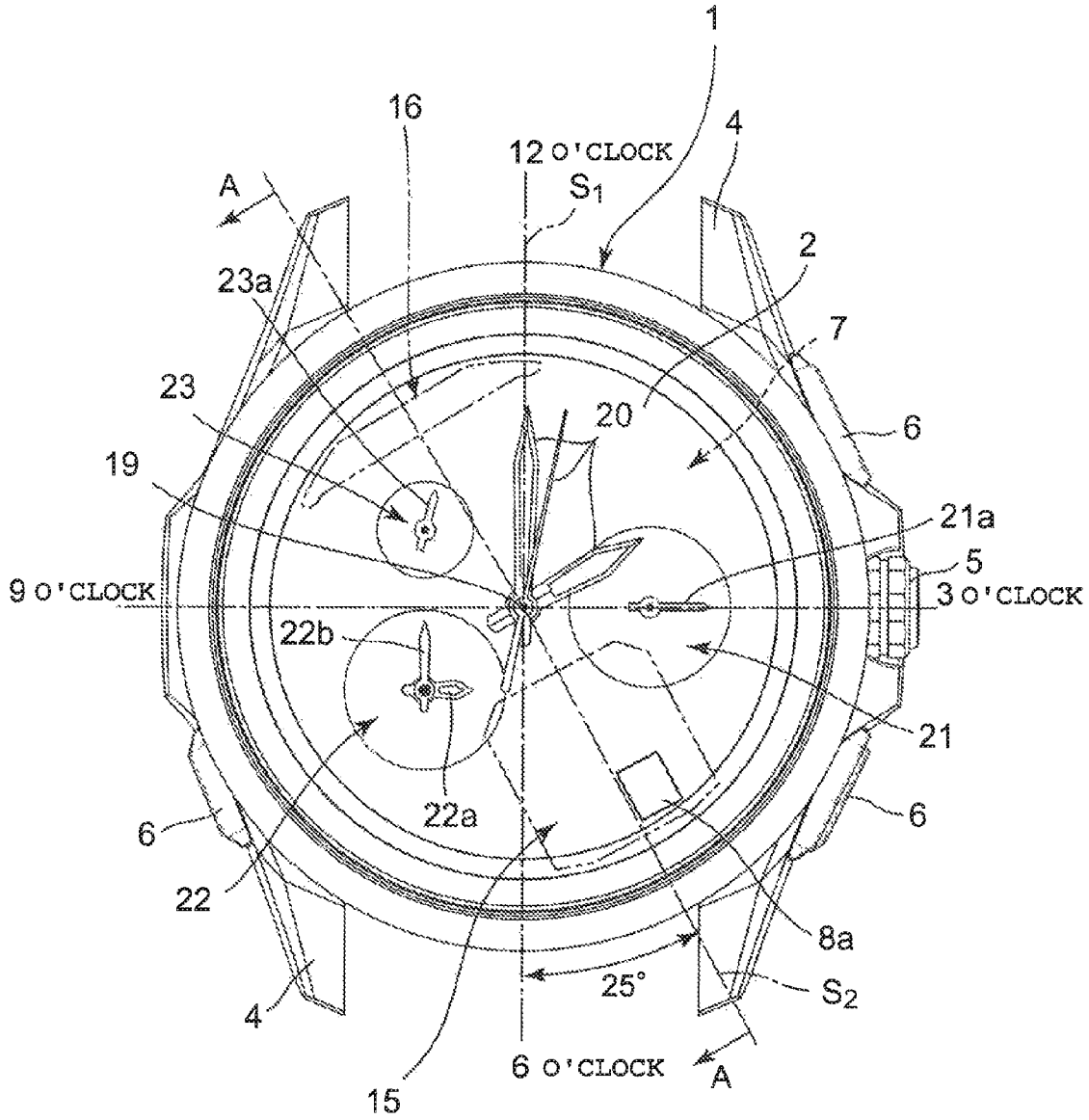
FIG. 1 is an enlarged front view of a first embodiment in which the present invention has been applied in a pointer type wristwatch.
Figure 2:
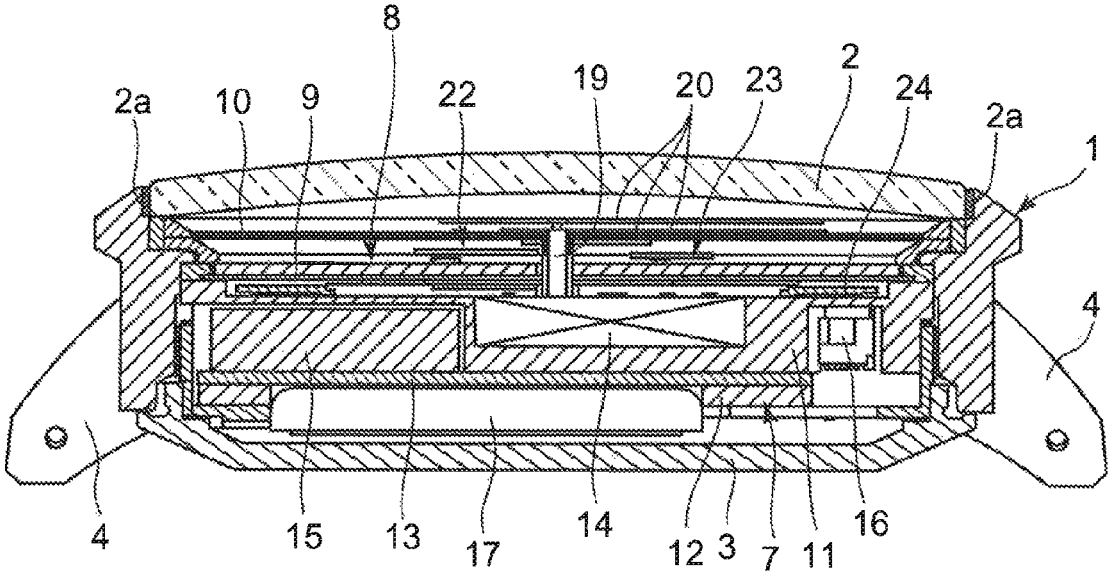
FIG. 2 is an enlarged sectional view of the wristwatch taken along line A-A in FIG. 1.

This wristwatch includes a wristwatch case 1 as shown in FIG. 1 and FIG. 2, and a watch glass 2 is attached to the upper opening portion of this wristwatch case 1 via a packing 2*a*. The lower portion of this wristwatch case 1 has a rear lid 3 attached thereto.

On the six o'clock side and the twelve o'clock side of the outside surface of this wristwatch case 1, band attaching sections 4 are provided, respectively, as shown in FIG. 1 and FIG. 2. Also, this wristwatch case 1 has a crown 5 provided on its side surface on the three o'clock side and push-button switches 6 provided on its side surfaces on the two o'clock side, the four o'clock side, and the eight o'clock side, respectively.

Inside this wristwatch case 1, a timepiece module 7 is mounted as shown in FIG. 2, and a dial plate 8 is arranged above the timepiece module 7 via a solar panel 9. On the upper side of the peripheral portion of this dial plate 8, a ring-shaped parting member 10 is provided.

The timepiece module 7 includes an upper housing 11 and a lower housing 12, and a circuit board 13 is arranged between the upper housing 11 and the lower housing 12, as shown in FIG. 2. In this embodiment, a timepiece movement 14, a first antenna 15, and a second antenna 16 are mounted in the upper housing 11, and a button battery 17 is provided in the lower housing 12.

The timepiece movement 14 has a pointer shaft 19 inserted into a through hole 18 provided in the center portions of the dial plate 8 and the solar panel 9, as shown in FIG. 1 and FIG. 2. In this embodiment, pointers 20 made of a metallic material, such as an hour hand, a minute hand, and a second pointer, are attached to the top end of the pointer shaft 19. As a result, the timepiece movement 14 is structured to move the pointers 20 above the dial plate 8 by rotating the pointer shaft 19, and thereby indicate and display the time.

Figure 3:
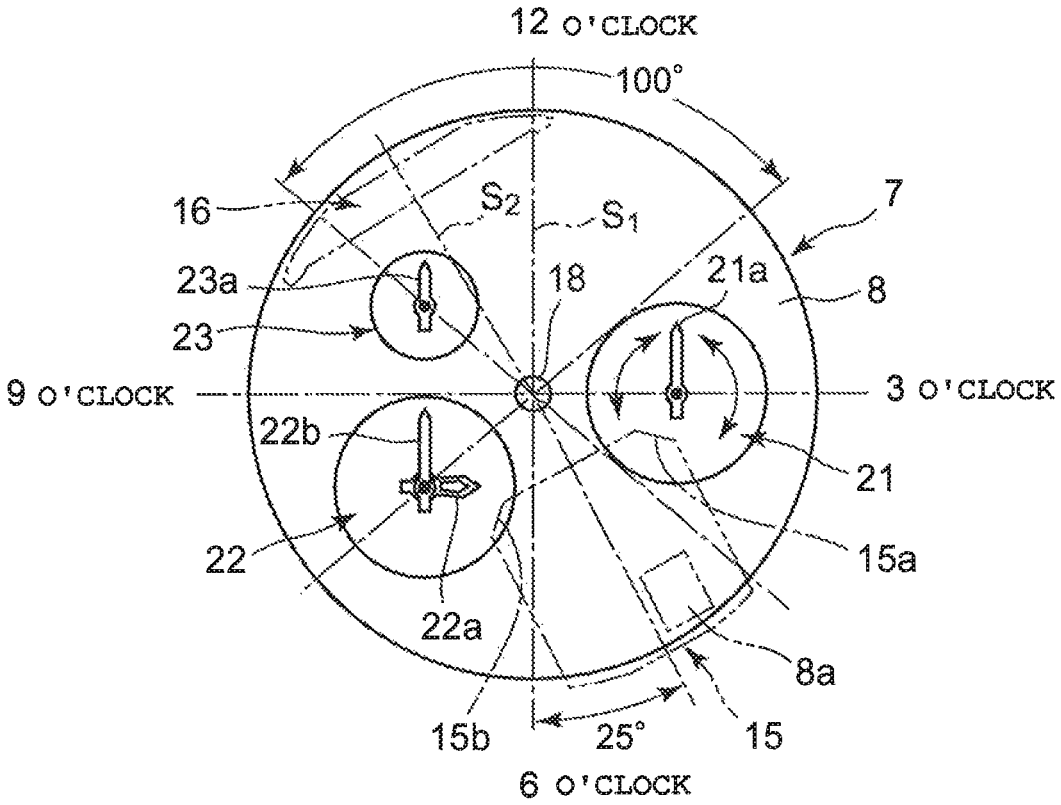
FIG. 3 is an enlarged front view of a timepiece module in the wristwatch shown in FIG. 1, in which a dial plate has been arranged above the timepiece module.
Figure 4:
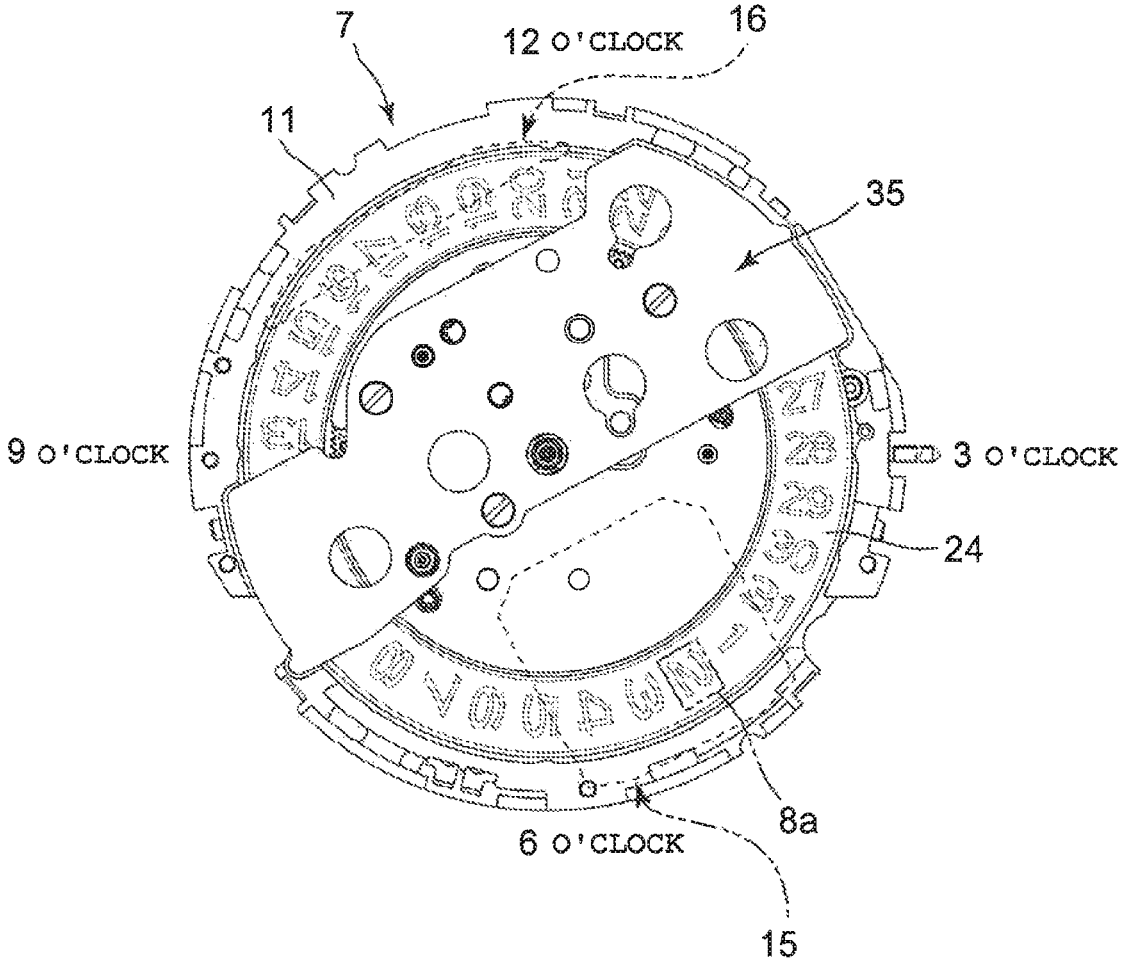
FIG. 4 is an enlarged front view of the timepiece module in the wristwatch shown in FIG. 1, in which the dial plate has been removed.

Also, the timepiece movement 14 is structured to move a first short pointer 21*a* of a first sub-display section 21 made of a metallic material, two second short pointers 22*a* and 22*b* of a second sub-display section 22 made of a metallic material, and a third short pointer 23*a* of a third sub-display section 23 made of a metallic material, respectively, above the dial plate 8, as shown in FIG. 1 to FIG. 3; and to rotate a date wheel 24 below the dial plate 8, as shown in FIG. 2 and FIG. 4.

In this embodiment, the first sub-display section 21, which displays the mode of a clock function or the temperature or humidity of external environment, includes the first short pointer 21*a*, as shown in FIG. 1 and FIG. 3. This first sub-display section 21 is arranged in an area between the through hole 18 in the center of the dial plate 8 and an end portion of the dial plate 8 on the three o'clock side. The rotation range of the first short pointer 21*a* of the first sub-display section 21 is set to a predetermined angle range, such as an angle range of about 180 to 300 degrees. In this first embodiment, the rotation range is set to an angle range of around 250 degrees.

Also, the second sub-display section 22, which displays the time of each city in the world, includes the two second short pointers 22*a* and 22*b*, as shown in FIG. 1 and FIG. 3. This second sub-display section 22 is arranged in an area between the through hole 18 in the center of the dial plate 8 and an end portion of the dial plate 8 on the eight o'clock side. In addition, this second sub-display section 22 is structured such that the two second short pointers 22*a* and 22*b* move in conjunction with each other by a wheel train mechanism and rotate by 360 degrees.

Moreover, the third sub-display section 23, which displays a time such as the time of an alarm or a timer, includes the third short pointer 23*a*, as shown in FIG. 1 and FIG. 3. This third sub-display section 23 is arranged in an area between the through hole 18 in the center of the dial plate 8 and an end portion of the dial plate 8 on the ten o'clock side, and the third short pointer 23*a* thereof rotates by 360 degrees.

The date wheel 24 is formed into a ring shape, and the dates 1 to 31 are drawn on its upper surface such that one of the dates corresponds to a date window 8*a* on the four o'clock side of the dial plate 8, as shown in FIG. 4. That is, the date wheel 24 is rotatably arranged above the peripheral portion of the upper surface of the upper housing 11, as shown in FIG. 2 and FIG. 4. In this embodiment, the upper surface of the date wheel 24 is held by an anti-magnetic plate 35 so that the date wheel 24 is rotatably held above the upper housing 11.

This anti-magnetic plate 35 is to prevent the timepiece movement 14 from being affected by an external magnetic field. One end portion of the anti-magnetic plate 35 is attached to a portion of the upper housing 11 on the two o'clock side and the other end portion thereof is attached to a portion of the upper housing 11 on the eight o'clock side, as shown in FIG. 4. That is, the anti-magnetic plate 35 is arranged above the date wheel 24 such that the upper sides of the first antenna 15 and the second antenna 16 are not covered thereby. As a result, the date wheel 24 is structured to be driven and rotated by a predetermined angle once a day by the timepiece movement 14, whereby a date displayed corresponding to the date window 8*a* is switched.

The first antenna 15 is a patch antenna that receives a high-frequency radio wave for GPS (for example, a radio wave of 1575.42 MHz), and the second antenna 16 is a bar antenna that receives a standard time radio wave that is a long wave (for example, a radio wave of 40 to 77.5 kHz). These first antenna 15 and second antenna 16 are arranged in end portions of the timepiece module 7 opposing each other, as shown in FIG. 1 to FIG. 3.

That is, the first antenna 15 and the second antenna 16 are arranged opposing each other within an angle range of about 100 degrees formed by the end portions of a straight line S1 connecting the twelve o'clock point and the six o'clock point being rotated centering on the middle point of the straight line S1 by about 50 degrees toward the sides, as shown in FIG. 1 and FIG. 3. In this embodiment, the first antenna 15 is arranged in an area located from around the four o'clock portion of the timepiece module 7 to substantially the six o'clock portion via the five o'clock portion.

That is, the first antenna 15 is arranged corresponding to a long side of a triangle connecting the central portions of the sub-display sections 21 to 23 in a manner not to be affected by the sub-display sections 21 to 23 as much as possible. Also, the second antenna 16 is arranged in an area located from around the ten o'clock portion of the timepiece module 7 to substantially the twelve o'clock portion via the eleven o'clock portion.

In this embodiment, the first antenna 15 is arranged in an area between the through hole 18 in the center of the dial plate 8 and an end portion of the dial plate 8 on the five o'clock side, as shown in FIG. 1 to FIG. 3. That is, the first antenna 15 is provided such that its center portion is positioned on a straight line S2 that intersects with the straight line S1, which is connecting the twelve o'clock portion and the six o'clock portion of the dial plate 8, at the center of the dial plate 8 at an angle of about 25 degrees in the counter clockwise direction.

Also, the first antenna 15 is structured such that its antenna field has a substantially square shape; its side portion on the outer periphery side of the timepiece module 7 is positioned between an area around the four o'clock point and an area around the six o'clock point; one corner 15*a* of corners 15*a* and 15*b* at the sides of its side portion near the through hole 18 in the center of the timepiece module 7 projects into and overlaps with the area of the first sub-display section 21; and the other corner 15*b* is positioned close to or slightly projects into and overlaps with the area of the second sub-display section 22, as shown in FIG. 1 to FIG. 3.

In this embodiment, the first antenna 15 is structured such that, although one corner 15*a* of the corners 15*a* and 15*b* of the side portion near the through hole 18 in the center of the timepiece module 7 projects significantly into the area of the first sub-display section 21, the first short pointer 21*a* of the first sub-display section 21 is not moved or stopped above the first antenna 15, as shown in FIG. 1 and FIG. 3. As a result, the first antenna 15 is structured such that the effect of the first short pointer 21*a* on reception performance when a high-frequency radio wave for GPS is received can be reduced.

That is, the rotation range of the first short pointer 21*a* is set to a predetermined angle range, such as an angle range of about 250 degrees, and a portion of the first sub-display section 21 that is not within this range overlaps with the area of the first antenna 15. As a result of this structure, the reception performance of the first antenna 15 when receiving a high-frequency radio wave for GPS is not degraded by the first short pointer 21*a*.

In addition, since the first antenna 15 is arranged such that the other corner 15*b* of the corners 15*a* and 15*b* of the side portion near the through hole 18 in the center of the timepiece module 7 is positioned close to or projects slightly into the area of the second sub-display section 22 as shown in FIG. 1 to FIG. 3, the reception performance of the first antenna 15 when receiving a high-frequency radio wave for GPS is hardly affected by the second short pointers 22*a* and 22*b*.

The second antenna 16 is arranged corresponding to an outer peripheral portion of the dial plate 8 on the eleven o'clock side which is located opposite to the first antenna 15, as shown in FIG. 1 to FIG. 3. Specifically, this second antenna 16 is an elongated bar antenna having a coil wound on the core, and its center is positioned on the straight diagonal line S2 passing through the center line of the first antenna 15.

In this embodiment, the second antenna 16 is provided in the upper housing 11 along the outer periphery of the dial plate 8 with its one end portion corresponding to the twelve o'clock portion of the dial plate 8 and the other end portion corresponding to the ten o'clock portion of the dial plate 8, as shown in FIG. 1 to FIG. 3. As a result, the second antenna 16 is arranged such that the third sub-display section 23 does not overlap therewith, whereby the reception performance of the second antenna 16 when receiving a long wave such as a standard time radio wave is not affected by the third short pointer 23*a* of the third sub-display section 23.

The solar panel 9 arranged between the timepiece module 7 and the dial plate 8 receives extraneous light and generates electricity. This solar panel 9 has an outer shape that is almost the same as that of the dial plate 8, and includes a plurality of cells 9*a* having the same light-receiving areas and arranged substantially radially, as shown in FIG. 5.

Specifically, the plurality of cells 9*a* are each structured such that a lower electrode made of metal such as aluminum is provided on a film substrate, a semiconductor layer such as amorphous silicon (a-Si) is provided on this lower electrode, and a transparent upper electrode such as ITO (Indium Tin Oxide) is provided on this semiconductor layer. By these lower electrodes and upper electrodes being respectively connected, the plurality of cells 9*a* are connected in series.

Figure 5:
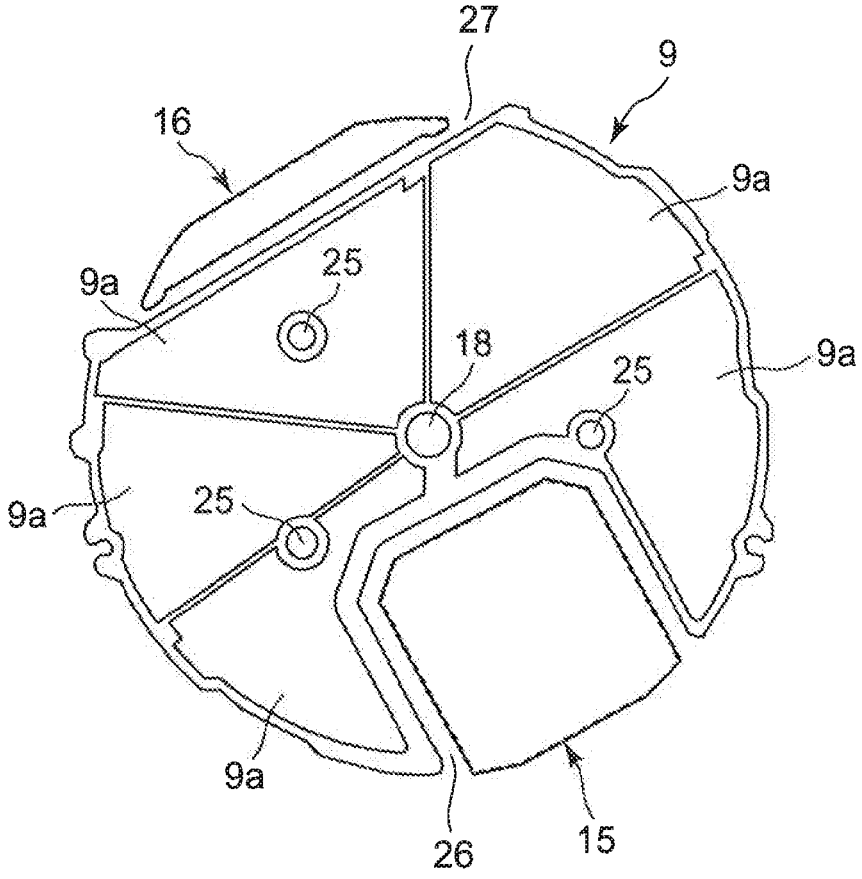
FIG. 5 is an enlarged front view of a solar panel, a first antenna, and a second antenna in the timepiece module shown in FIG. 3.

In the center of the solar panel 9, the through hole 18 is provided into which the pointer shaft 19 is inserted, as shown in FIG. 5. In addition, the solar panel 9 has through holes 25 into which the shaft (not shown) of the first short pointer 21*a* of the first sub-display section 21, the shafts (not shown) of the second short pointers 22*a* and 22*b* of the second sub-display section 22, and the shaft (not shown) of the third short pointer 21*a* of the third sub-display section 23 are inserted, respectively.

In this embodiment, the lower electrodes and the upper electrodes of the plurality of cells 9*a* of the solar panel 9 are made of metal, which may degrade the reception performance of the first antenna 15 and the second antenna 16. Therefore, in this solar panel 9, a first non-power-generation section 26 is provided in an area corresponding to the first antenna 15, and a second non-power-generation section 27 is provided in an area corresponding to the second antenna 16, as shown in FIG. 5.

Specifically, the first non-power-generation section 26 is formed by an area corresponding to the first antenna 15 being cut off to form a square field that does not receive extraneous light, as shown in FIG. 5. Also, the second non-power-generation section 27 is formed by an area corresponding to the second antenna 16 being cut off to form a substantially ark-shaped field that does not receive extraneous light.

Figure 6:
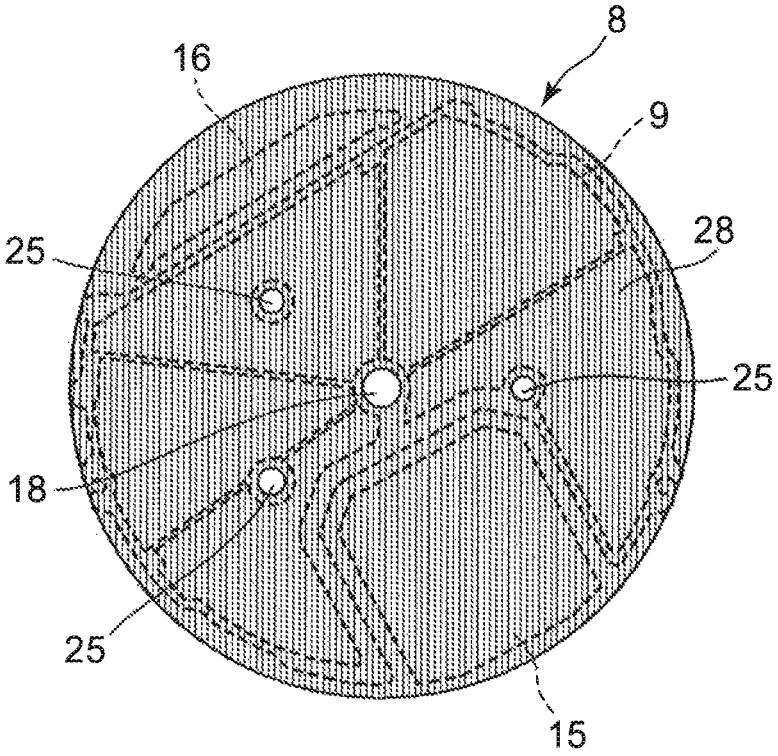
FIG. 6 is an enlarged front view of the dial plate above the timepiece module shown in FIG. 3, in which the dial plate has a stripe pattern.

As a result, height differences occur at a boundary between a portion of the solar panel 9 around the first non-power-generation section 26 and the first antenna 15 and a boundary between a portion of the solar panel 9 around the second non-power-generation section 27 and the second antenna 16. Accordingly, the dial plate 8 has a stripe pattern 28 so as to hide the height differences at these boundaries, as shown in FIG. 6. That is, the dial plate 8 is constituted by a transparent or translucent resin sheet having the stripe pattern 28 formed on its surface.

This stripe pattern 28 of the dial plate 8 is formed by a pattern of a number of thin lines tilted at a predetermined angle with respect to the boundary between the first non-power-generation section 26 and the solar panel 9 and the boundary between the second non-power-generation section 27 and the solar panel 9 being provided. In this embodiment, these thin lines are straight lines that intersect with the straight line S2 connecting the center of the first antenna 15 and the center of the second antenna 16, such as straight lines parallel to the straight line S1 connecting the twelve o'clock portion and the six o'clock portion of the dial plate 8.

As a result, the stripe pattern 28 of the dial plate 8 is formed such that the height differences at the boundary between a portion of the solar panel 9 around the first non-power-generation section 26 and the first antenna 15 and the boundary between a portion of the solar panel 9 around the second non-power-generation section 27 and the second antenna 16 do not draw attention. Note that the dial plate 8 is structured such that, although the stripe pattern 28 is provided on the surface thereof, extraneous light penetrates the stripe pattern 28 and irradiates the solar panel 9.

Next, the operation of this wristwatch is described.

When the wristwatch worn on a wrist is to be used, the six o'clock side of the wristwatch case 1 is positioned on the user's body side, and the twelve o'clock side thereof is positioned on the side opposite to the user's body side. As a result, the twelve o'clock side of the wristwatch case 1 is positioned away from the user's body and exposed.

In this state, when a high-frequency radio wave for GPS is to be received by the first antenna 15, this radio wave comes into the wristwatch from ahead of the user's body toward the first antenna 15. Here, although there is the solar panel 9 between the timepiece module 7 and the dial plate 8, the high-frequency radio wave for GPS is transmitted to the first antenna 15 through the first non-power-generation section 26 provided in the solar panel 9. As a result, the high-frequency radio wave for GPS is received by the first antenna 15.

In this embodiment, although one corner 15*a* of the corners 15*a* and 15*b* at the sides of the side portion of the first antenna 15 near the through hole 18 in the center of the timepiece module 7 has projected into and overlapped with the area of the first sub-display section 21, the first short pointer 21*a* of the first sub-display section 21 does not move above the area of the first antenna 15, and therefore the effect of the first short pointer 21*a* on the reception performance of the first antenna 15 is reduced.

That is, since the rotation range of the first short pointer 21*a* of the first sub-display section 21 has been set to a predetermined angle range such as an angle range of about 250 degrees as shown in FIG. 1 and FIG. 3, the first short pointer 21*a* does not move above the area of the first antenna 15 although a portion of the first sub-display section 21 has overlapped with the area of the first antenna 15. Therefore, the reception performance of the first antenna 15 is not degraded by the first short pointer 21*a* of the first sub-display section 21, so that the high-frequency radio wave for GPS is favorably received by the first antenna 15.

In addition, although the other corner 15*b* of the corners 15*a* and 15*b* of the side portion of the first antenna 15 near the through hole 18 in the center of the timepiece module 7 has been arranged close to or has slightly projected into and overlapped with the area of the second sub-display section 22 as shown in FIG. 1 and FIG. 3, the reception performance of the first antenna 15 is hardly affected by the two second short pointers 22*a* and 22*b*. Therefore, the high-frequency radio wave for GPS is favorably received by the first antenna 15.

On the other hand, when a standard time radio wave, which is a long wave, is to be received by the second antenna 16, this radio wave comes into the wristwatch from ahead of the user's body toward the second antenna 16. In this case as well, although there is the solar panel 9 between the timepiece module 7 and the dial plate 8, the standard time radio wave, which is a long wave, is transmitted to the second antenna 16 through the second non-power-generation section 27 provided in the solar panel 9.

Accordingly, the standard time radio wave, which is a long wave, is favorably received by the second antenna 16. In this embodiment, since the second antenna 16 has been arranged such that the third sub-display section 23 does not overlap therewith, the reception performance of the second antenna 16 is hardly affected by the third short pointer 23*a* of the third sub-display section 23. As a result of this structure, long waves, such as standard time radio waves, are favorably received by the second antenna 16.

Also, regardless of whether the first antenna 15 and the second antenna 16 are receiving two types of radio waves having different wavelengths as described above, extraneous light, such as sunlight, is received in the wristwatch case 1 through the watch glass 2, penetrates the dial plate 8, and irradiates the solar panel 9. Then, the extraneous light irradiated onto the solar panel 9 is received by the plurality of cells 9*a* of the solar panel 9, and the plurality of cells 9*a* generate electricity, respectively. This generated electric power is supplied to the circuit board 13 in the timepiece module 7, whereby the wristwatch is charged.

In this embodiment, although the height differences occur at the boundary between a portion of the solar panel 9 around the first non-power-generation section 26 and the first antenna 15 and the boundary between a portion of the solar panel 9 around the second non-power-generation section 27 and the second antenna 16, these height differences can be hidden by the stripe pattern 28 of the dial plate 8 so as not to draw attention.

That is, since the stripe pattern 28 of the dial plate 8 has been formed by a pattern of a number of thin lines tilted at a predetermined angle with respect to the boundary between the first non-power-generation section 26 and the solar panel 9 and the boundary between the second non-power-generation section 27 and the solar panel 9 being provided, these thin lines of the stripe pattern 28 intersect with the straight line S2 connecting the center of the first antenna 15 and the center of the second antenna 16, whereby the height differences do not draw attention.

As described above, this wrist watch includes the wristwatch case 1 provided with the watch glass 2, the dial plate 8 provided in the wristwatch case 1, and the timepiece module 7 arranged below the dial plate 8, and the timepiece module 7 has the first antenna 15 arranged in its one end portion so as to receive a high-frequency radio wave for GPS and the second antenna 16 arranged in the other end portion opposing the first antenna 15 so as to receive a radio wave whose frequency differs from that of the high-frequency radio wave for GPS, such as a standard time radio wave that is a long wave. As a result of this structure, radio waves having different frequencies can be favorably received.

That is, with this wristwatch, a high-frequency radio wave for GPS can be received by the first antenna 15 arranged in one end portion of the timepiece module 7, and a standard time radio wave which is a long wave and has a frequency differing from that of the high-frequency radio wave for GPS can be received by the second antenna 16 arranged in the other end portion of the timepiece module 7 opposing the first antenna 15. In other words, radio waves having different frequencies can be unfailingly and favorably received by the first antenna 15 and the second antenna 16.

In this embodiment, the first antenna 15 and the second antenna 16 have been arranged opposing each other within an angle range of about 100 degrees formed by the straight line S1 connecting the twelve o'clock point and the six o'clock point being rotated, as shown in FIG. 1 and FIG. 3. Accordingly, if the six o'clock side of the wristwatch case 1 is positioned on the user's body side and the twelve o'clock side thereof is positioned on the side opposite to the user's body side when the wristwatch worn on a wrist is used, the twelve o'clock side of the wristwatch case 1 is positioned away from the user's body and exposed, whereby the first antenna 15 and the second antenna 16 can favorably receive radio waves having different frequencies from the twelve o'clock side positioned away from the user's body.

That is, since the first antenna 15 has been arranged in an area located from around the four o'clock portion of the timepiece module 7 to substantially the six o'clock portion via the five o'clock portion and the second antenna 16 has been arranged in an area located from around the ten o'clock portion of the timepiece module 7 to substantially the twelve o'clock portion via the eleven o'clock portion, high-frequency radio waves for GPS can be favorably received from the twelve o'clock side of the wristwatch case 1 by the first antenna 15 and standard time radio waves that are long waves can be favorably received from the twelve o'clock side of the wristwatch case 1 by the second antenna 16.

Also, since the first antenna 15 has been arranged in the area located from around the four o'clock portion of the timepiece module 7 to substantially the six o'clock portion via the five o'clock portion and the second antenna 16 has been arranged in the area located from around the ten o'clock portion of the timepiece module 7 to substantially the twelve o'clock portion via the eleven o'clock portion, the crown 5 can be provided on the three o'clock side of the watch case 1 and the push-button switches 6 can be provided on the two o'clock side, the four o'clock side, and the eight o'clock side thereof, respectively. As a result of this structure, the operability of the switches is not impaired, and can be improved.

Also, in this wristwatch, although the timepiece module 7 includes the pointer shaft 19 inserted into the through hole 18 provided in the dial plate 8 and the pointers 20 attached to the upper end portion of this pointer shaft 19 are moved above the dial plate 8 so as to indicate the time, each reception performance of the first antenna 15 and the second antenna 16 is hardly affected by the pointers 20 even when the pointers 20 are moved above the dial plate 8, so that the first antenna 15 and the second antenna 16 can favorably receive radio waves having different frequencies.

Moreover, in this wristwatch, since the dial plate 8 has been constituted by a synthetic resin sheet that is light transmissive and the solar panel 9 which receives extraneous light and generates electricity has been arranged between the dial plate 8 and the timepiece module 7, extraneous light can irradiate the solar panel 9 through the dial plate 8, whereby the solar panel 9 can favorably generate electricity.

In this embodiment, at least an area of the solar panel 9 corresponding to the first antenna 15 has been formed as the first non-power-generation section 26 and, by this first non-power-generation section 26, radio waves can unfailingly and favorably pass through the solar panel 9 without being blocked. Accordingly, the reception performance of the first antenna 15 is not degraded by the solar panel 9, whereby the first antenna 15 can favorably receive high-frequency radio waves for GPS.

Also, an area of the solar panel 9 corresponding to the second antenna 16 has been formed as the second non-power-generation section 27 and, by this second non-power-generation section 27, radio waves can unfailingly and favorably pass through the solar panel 9 without being blocked. Accordingly, the reception performance of the second antenna 16 is not degraded by the solar panel 9, whereby the second antenna 16 can favorably receive standard time radio waves that are long waves.

In this embodiment, the stripe pattern 28 of lines tilted at a predetermined angle with respect to the boundary between the first non-power-generation section 26 and the solar panel 9 and the boundary between the second non-power-generation section 27 and the solar panel 9 has been provided on the dial plate 8. Therefore, although the height differences occur at the boundary between a portion of the solar panel 9 around the first non-power-generation section 26 and the first antenna 15 and the boundary between a portion of the solar panel 9 around the second non-power-generation section 27 and the second antenna 16, these height differences can be hidden by the stripe pattern 28 of the dial plate 8 so as not to draw attention.

That is, since the stripe pattern 28 of the dial plate 8 has been formed by a pattern of a number of thin lines tilted at a predetermined angle with respect to the boundary between the first non-power-generation section 26 and the solar panel 9 and the boundary between the second non-power-generation section 27 and the solar panel 9 being provided, these thin lines of the stripe pattern 28 intersect with the straight line S2 connecting the center of the first antenna 15 and the center of the second antenna 16, whereby the height differences can be hidden so as not to draw attention, and high-quality design can be provided.

Also, since the timepiece module 7 of this wristwatch has been structured such that the first sub-display section 21 including one first short pointer 21*a* and the second sub-display section 22 including two second short pointers 22*a* and 22*b* are provided to the sides of the first antenna 15, the time can be indicated by the pointers 20, the mode of a clock function or the temperature or humidity of external environment can be indicated by the first short pointer 21*a* of the first sub-display section 21, and the world time representing the time of each city in the world can be indicated by the second short pointers 22*a* and 22*b* of the second sub-display section 22, by which multifunctional display is achieved.

In this embodiment, although one corner 15*a* of the corners 15*a* and 15*b* at the sides of the side portion of the first antenna 15 near the through hole 18 in the center of the timepiece module 7 has projected into and overlapped with the area of the first sub-display section 21, the reception performance of the first antenna 15 is not degraded by the first short pointer 21*a* because the first short pointer 21*a* of the first sub-display section 21 is not moved above the first antenna 15.

That is, since the rotation range of the first short pointer 21*a* of the first sub-display section 21 has been set to a predetermined angle range such as an angle range of about 250 degrees as shown in FIG. 1 and FIG. 3, the first short pointer 21*a* does not move above the area of the first antenna 15 although a portion of the first sub-display section 21 has overlapped with the area of the first antenna 15. Therefore, the reception performance of the first antenna 15 is not degraded by the first short pointer 21*a* of the first sub-display section 21, so that high-frequency radio waves for GPS are favorably received by the first antenna 15.

In addition, although the other corner 15*b* of the corners 15*a* and 15*b* of the side portion of the first antenna 15 near the through hole 18 in the center of the timepiece module 7 has been arranged close to or has slightly projected into and overlapped with the area of the second sub-display section 22 as shown in FIG. 1 and FIG. 3, the reception performance of the first antenna 15 is hardly affected by the two second short pointers 22*a* and 22*b*, whereby high-frequency radio waves for GPS are favorably received by the first antenna 15.

Also, the timepiece module 7 of this wristwatch includes the third sub-display section 23 having the third short pointer 23*a* and provided near the second antenna 16. Accordingly, the time can be indicated by the pointers 20, the mode of a clock function or the temperature or humidity of external environment can be indicated by the first short pointer 21*a* of the first sub-display section 21, the time of each city in the world can be indicated by the second short pointers 22*a* and 22*b* of the second sub-display section 22, and a time such as the time of an alarm or a timer can be indicated by the third short pointer 23*a* of the third sub-display section 23, by which multifunctional display is achieved.

In this case as well, since the second antenna 16 has been arranged such that the third sub-display section 23 does not overlap therewith, the reception performance of the second antenna 16 is not degraded by the third short pointer 23*a* of the third sub-display section 23, whereby the second antenna 16 can favorably receive long waves such as standard time radio waves.

As described above, in this wristwatch, the first sub-display section 21 having the first short pointer 21*a* and the second sub-display section 22 having the two second short pointers 22*a* and 22*b* have been provided to the sides of the first antenna 15, and the third sub-display section 23 having the third short pointer 23*a* has been provided near the second antenna 16, whereby multifunctional display can be achieved and high-quality design can be provided.

Also, in this wristwatch, the anti-magnetic plate 35 has been arranged above the timepiece module 7 without covering the upper sides of the first antenna 15 and the second antenna 16, with one end portion of the anti-magnetic plate 35 being attached to the two o'clock side of the timepiece module 7 and the other end portion of the anti-magnetic plate 35 being attached to the eight o'clock side of the timepiece module 7. Accordingly, the timepiece movement 14 of the timepiece module 7 is prevented by the anti-magnetic plate 35 from being affected by an external magnetic field, without the reception performance of the first antenna 15 and the second antenna 16 being affected by the anti-magnetic plate 35.

Figure 7:
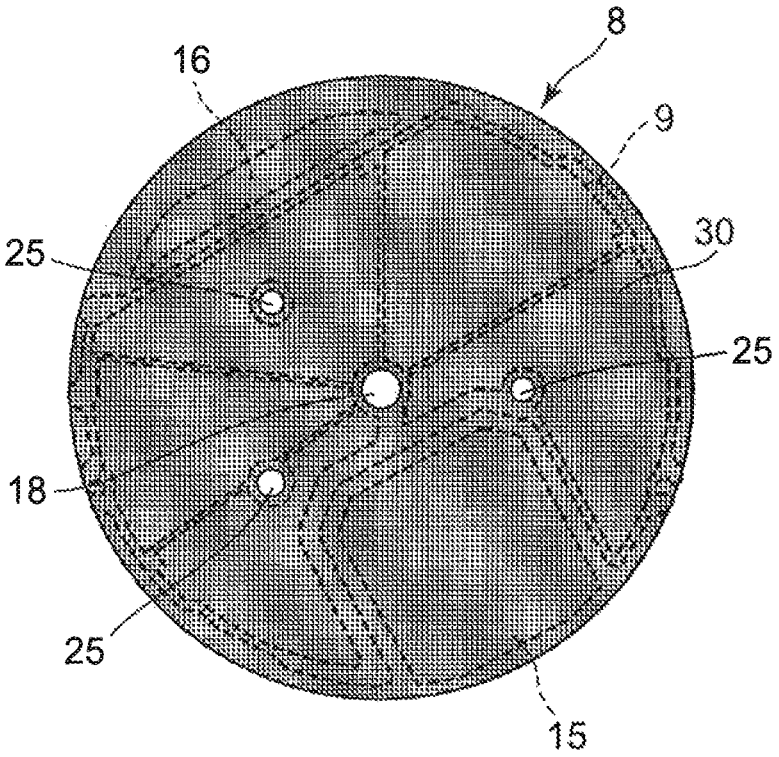
FIG. 7 is an enlarged front view of a first modification example of the dial plate in the wristwatch where the present invention has been applied, in which the dial plate has a lattice pattern.
Figure 8:
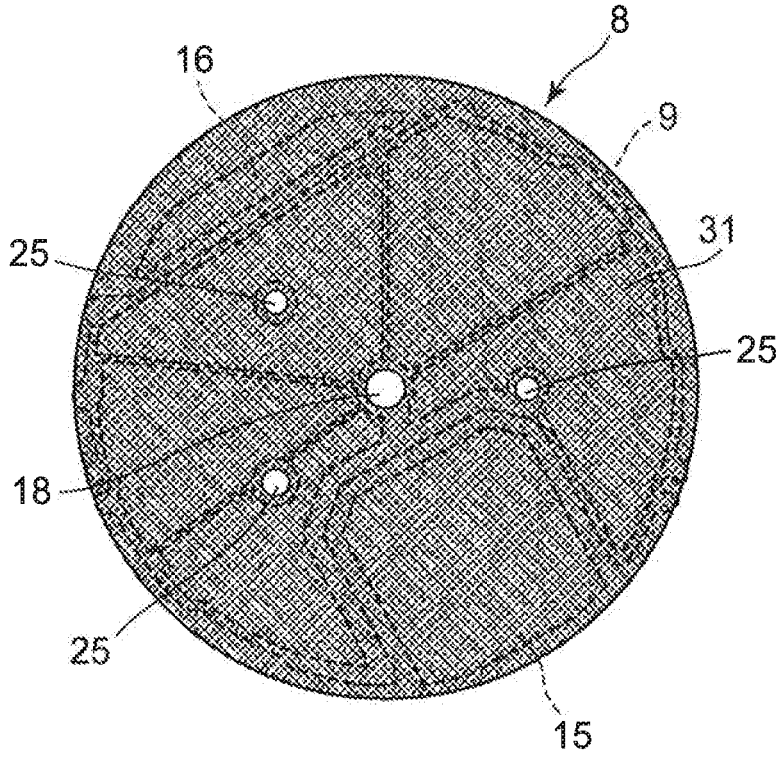
FIG. 8 is an enlarged front view of a second modification example of the dial plate in the wristwatch where the present invention has been applied, in which the dial plate has a checkered pattern.
Figure 9:
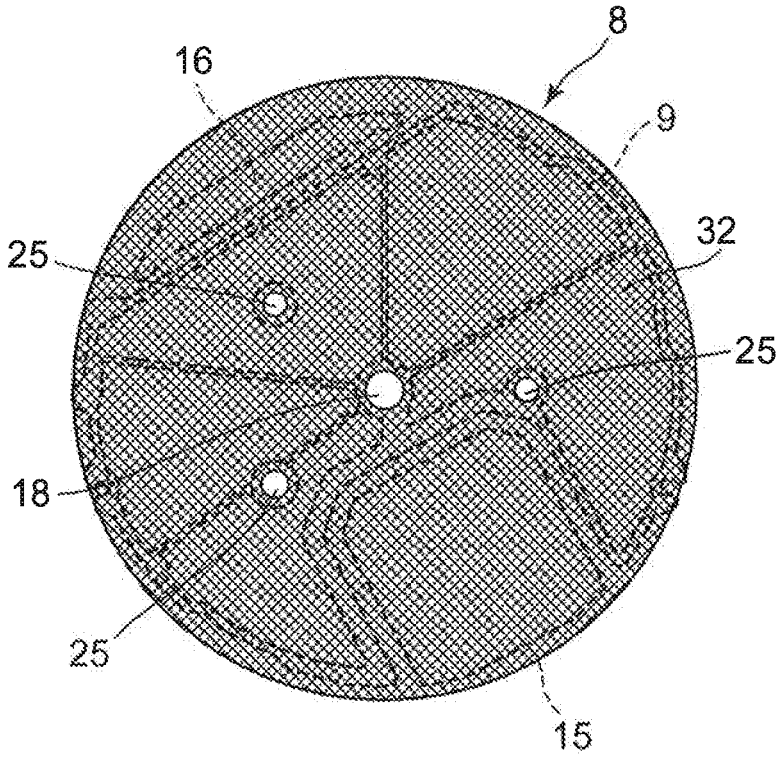
FIG. 9 is an enlarged front view of a third modification example of the dial plate in the wristwatch where the present invention has been applied, in which the dial plate has a lattice pattern.

Note that, although the stripe pattern 28 has been provided on the dial plate 8 in the first embodiment, the present invention is not limited thereto, and a pattern such as that of a first modification example in FIG. 7, a second modification example in FIG. 8, or a third modification example in FIG. 9 may be provided.

Specifically, in the first modification example shown in FIG. 7, a lattice pattern 30 formed by a number of thin lines extending in the direction of twelve o'clock to six o'clock and the direction of three o'clock to nine o'clock and intersecting with the boundary lines between the solar panel 9 and the first non-power-generation section 26 and between the solar panel 9 and the second non-power-generation section 27 has been provided on the dial plate 8.

By this lattice pattern 30 of the dial plate 8 in the first modification example as well, the height differences occurred at the boundary between a portion of the solar panel 9 around the first non-power-generation section 26 and the first antenna 15 and the boundary between a portion of the solar panel 9 around the second non-power-generation section 27 and the second antenna 16 can be hidden so as not to draw attention, whereby high-quality design can be provided.

Also, in the second modification example shown in FIG. 8, a checkered pattern 31 cyclically formed at predetermined intervals along directions intersecting with the boundary lines between the solar panel 9 and the first non-power-generation section 26 and between the solar panel 9 and the second non-power-generation section 27 has been provided on the dial plate 8.

By this checkered pattern 31 of the dial plate 8 in the second modification example as well, the height differences occurred at the boundary between a portion of the solar panel 9 around the first non-power-generation section 26 and the first antenna 15 and the boundary between a portion of the solar panel 9 around the second non-power-generation section 27 and the second antenna 16 can be hidden so as not to draw attention, whereby high-quality design can be provided.

Moreover, in the third modification example shown in FIG. 9, a lattice pattern 32 formed by a number of thin lines tilted at 45 degrees and intersecting with the boundary lines between the solar panel 9 and the first non-power-generation section and between the solar panel 9 and the second non-power-generation section 27 has been provided on the dial plate 8.

By this lattice pattern 32 of the third modification example as well, the height differences occurred at the boundary between a portion of the solar panel 9 around the first non-power-generation section 26 and the first antenna 15 and the boundary between a portion of the solar panel 9 around the second non-power-generation section 27 and the second antenna 16 can be hidden so as not to draw attention, whereby high-quality design can be provided.

Second Embodiment

Next, a second embodiment in which the present invention has been applied in a pointer type wristwatch is described with reference to FIG. 10. Note that sections identical to those in the first embodiment shown in FIG. 1 to FIG. 6 are provided with the same reference numerals.

The structure of this wristwatch is the same as that of the first embodiment except the arrangement positions of the first antenna 15 and the second antenna 16 and the arrangement positions of the first sub-display section 21, the second sub-display section 22, and the third sub-display section 23.

Figure 10:
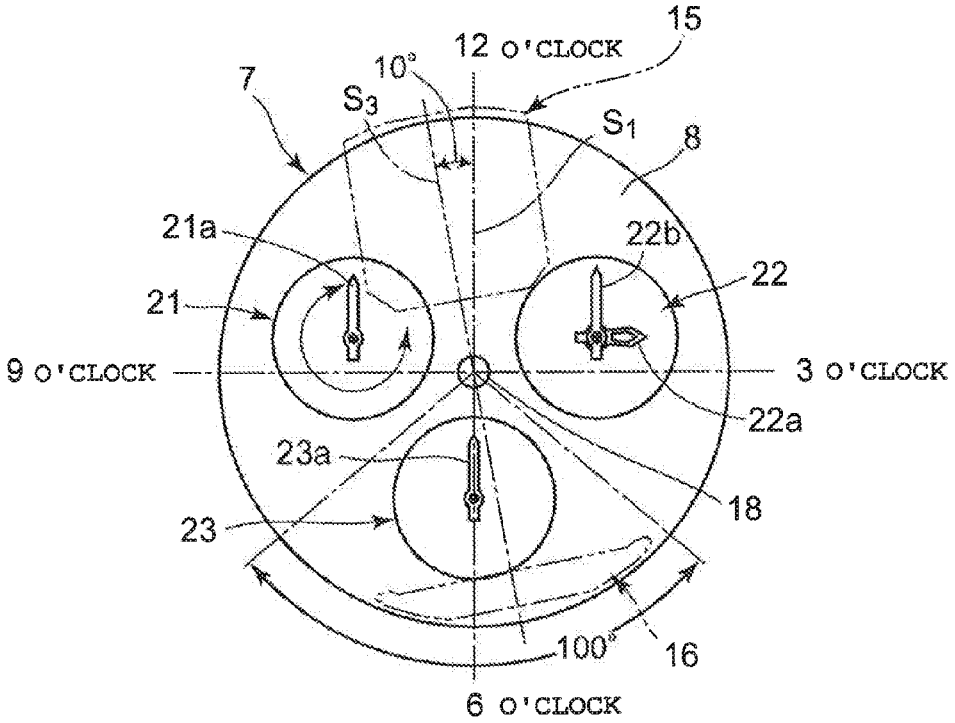
FIG. 10 is an enlarged front view of a timepiece module in a second embodiment where the present invention has been applied in a pointer type wristwatch, in which a dial plate has been arranged above the timepiece module.

Specifically, the first antenna 15 is arranged on the twelve o'clock side of the timepiece module 7 and the second antenna 16 is arranged on the six o'clock side of the timepiece module 7 opposing the first antenna 15, as shown in FIG. 10. In this embodiment as well, the first antenna 15 and the second antenna 16 are arranged opposing each other within an angle range of about 100 degrees formed by the straight line S1 connecting the twelve o'clock point and the six o'clock point being rotated.

In this embodiment, the first antenna 15 is arranged in an area located from around the ten o'clock portion of the timepiece module 7 to around the one o'clock portion via the twelve o'clock portion and the second antenna 16 is arranged in an area located from around the four o'clock portion of the timepiece module 7 to around the seven o'clock portion via the six o'clock portion, as shown in FIG. 10.

Specifically, the first antenna 15 is arranged in an area between the through hole 18 in the center of the dial plate 8 and an end portion of the dial plate 8 on the eleven o'clock side, as shown in FIG. 10. The center of this first antenna 15 is positioned on a straight line S3 that intersects with the straight line S1 connecting the twelve o'clock portion and the six o'clock portion of the dial plate 8 at the center of the dial plate 8 at an angle of about 10 degrees in the counter clockwise direction.

Also, the second antenna 16 is arranged such that its center is positioned on the straight line S3 passing through the center of the first antenna 15, as shown in FIG. 10. In this embodiment, the second antenna 16 is arranged in the time piece module 7 along the outer periphery of the dial plate 8, with its one end portion corresponding to an area around the four o'clock portion of the dial plate 8 and the other end portion corresponding to an area around the seven o'clock portion of the dial plate 8.

The first sub-display section 21, which displays the mode of a clock function or the temperature or humidity of external environment, includes the first short pointer 21*a*, as with the first embodiment. This first sub-display section 21 is arranged in an area between the through hole 18 in the center of the dial plate 8 and an end portion of the dial plate 8 located on substantially the nine o'clock side, as shown in FIG. 10. The rotation range of the first short pointer 21*a* of the first sub-display section 21 is set to a predetermined angle range, such as an angle range of about 180 to 300 degrees. In this second embodiment, the rotation range is set to an angle range of around 250 degrees.

Also, the second sub-display section 22, which displays the time of each city in the world, includes the two second short pointers 22*a* and 22*b*, as with the first embodiment. This second sub-display section 22 is arranged in an area between the through hole 18 in the center of the dial plate 8 and an end portion of the dial plate 8 located on substantially the three o'clock side, and the second short pointers 22*a* and 22*b* thereof rotate by 360 degrees, respectively, as shown in FIG. 10.

Moreover, the third sub-display section 23, which displays a time such as the time of an alarm or a timer, includes the third short pointer 23*a*, as with the first embodiment. This third sub-display section 23 is arranged in an area between the through hole 18 in the center of the dial plate 8 and an end portion of the dial plate 8 on the six o'clock side, and the third short pointer 23*a* thereof rotates by 360 degrees, as shown in FIG. 10.

Also, the first antenna 15 is structured such that its antenna field has a substantially square shape; its side portion on the outer periphery side of the timepiece module 7 is positioned between an area around the ten o'clock point and an area around the one o'clock point; one corner 15*a* of the corners 15*a* and 15*b* at the sides of its side portion near the through hole 18 in the center of the timepiece module 7 projects into and overlaps with the area of the first sub-display section 21; and the other corner 15*b* is arranged close to the second sub-display section 22, as shown in FIG. 10.

The second antenna 16 is structured such that its center is positioned on the straight line S3 passing through the center of the first antenna 15, as shown in FIG. 10. This second antenna 16 is arranged in the time piece module 7 along the outer periphery of the dial plate 8, with its one end portion corresponding to an area around the four o'clock portion of the dial plate 8 and the other end portion corresponding to an area around the seven o'clock portion of the dial plate 8.

In this embodiment as well, the second antenna 16 is arranged such that the third sub-display section 23 does not overlap therewith, whereby the reception performance of the second antenna 16 is hardly affected by the third short pointer 23*a* of the third sub-display section 23 when the second antenna 16 receives a long wave such as a standard time radio wave.

With this wristwatch of the second embodiment as well, a high-frequency radio wave for GPS can be received by the first antenna 15 arranged in one end portion of the timepiece module 7, and a standard time radio wave which is a long wave and has a frequency differing from that of the high-frequency radio wave for GPS can be received by the second antenna 16 arranged in the other end portion of the timepiece module 7 opposing the first antenna 15, as in the case of the first embodiment. That is, radio waves having different frequencies can be unfailingly and favorably received by the first antenna 15 and the second antenna 16.

In this embodiment as well, the first antenna 15 and the second antenna 16 have been arranged opposing each other within an angle range of about 100 degrees formed by the straight line S1 connecting the twelve o'clock point and the six o'clock point being rotated. Accordingly, if the six o'clock side of the wristwatch case 1 is positioned on the user's body side and the twelve o'clock side thereof is positioned on the side opposite to the user's body side when the wristwatch worn on a wrist is used, the twelve o'clock side of the wristwatch case 1 is positioned away from the user's body and exposed, whereby the first antenna 15 and the second antenna 16 can favorably receive radio waves having different frequencies from the twelve o'clock side positioned away from the user's body.

That is, since the first antenna 15 has been arranged in an area located from around the ten o'clock portion of the timepiece module 7 to around the one o'clock portion via the twelve o'clock portion and the second antenna 16 has been arranged in an area located from around the four o'clock portion of the timepiece module 7 to around the seven o'clock portion via the six o'clock portion, high-frequency radio waves for GPS can be favorably received from the twelve o'clock side of the wristwatch case 1 by the first antenna 15 and standard time radio waves that are long waves can be favorably received from the twelve o'clock side of the wristwatch case 1 by the second antenna 16.

In this embodiment, although one corner 15*a* of the corners 15*a* and 15*b* at the sides of the side portion of the first antenna 15 near the through hole 18 in the center of the timepiece module 7 has projected into and overlapped with the area of the first sub-display section 21, the reception performance of the first antenna 15 is not degraded by the first short pointer 21*a* because the first short pointer 21*a* of the first sub-display section 21 is not moved above the first antenna 15.

In addition, although the other corner 15*b* of the corners 15*a* and 15*b* of the side portion of the first antenna 15 near the through hole 18 in the center of the timepiece module 7 has been arranged close to the area of the second sub-display section 22, the reception performance of the first antenna 15 is hardly affected by the two second short pointers 22*a* and 22*b*, whereby high-frequency radio waves for GPS are favorably received by the first antenna 15.

Also, since the second antenna 16 has been arranged such that the third sub-display section 23 does not overlap therewith, the reception performance of the second antenna 16 is not degraded by the third short pointer 23*a* of the third sub-display section 23, whereby the second antenna 16 can favorably receive long waves such as standard time radio waves.

Third Embodiment

Next, a third embodiment in which the present invention has been applied in a pointer type wristwatch is described with reference to FIG. 11. In this embodiment as well, sections identical to those in the first embodiment shown in FIG. 1 to FIG. 6 are provided with the same reference numerals.

The structure of this wristwatch of the third embodiment is the same as that of the first embodiment except the arrangement positions of the first antenna 15 and the second antenna 16 and the arrangement positions of the first sub-display section 21, the second sub-display section 22, and the third sub-display section 23.

Figure 11:
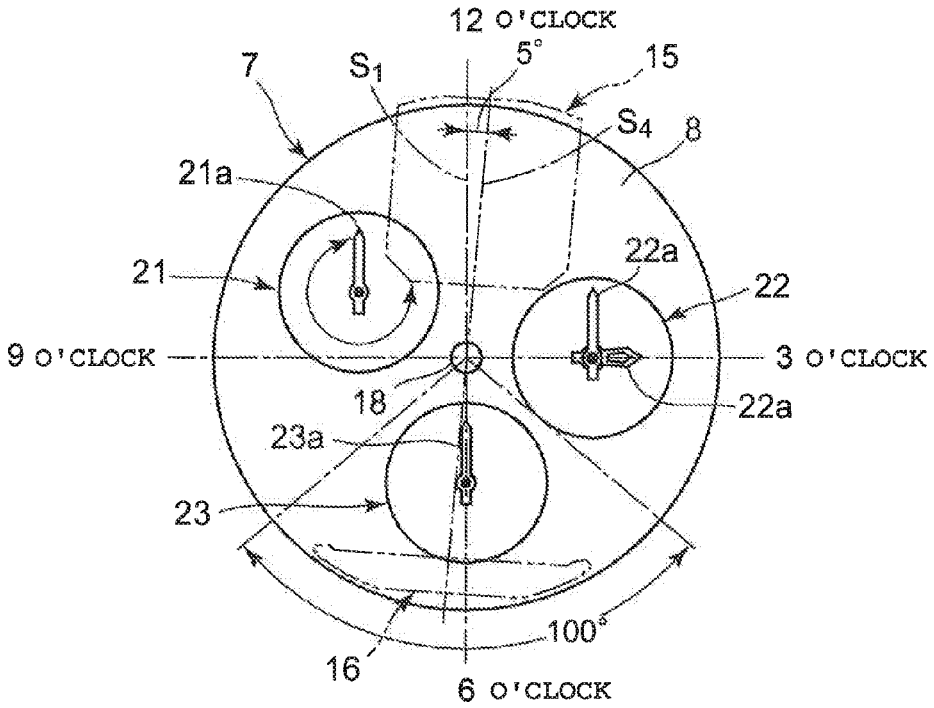
FIG. 11 is an enlarged front view of a timepiece module in a third embodiment where the present invention has been applied in a pointer type wristwatch, in which a dial plate has been arranged above the timepiece module.

Specifically, the first antenna 15 is arranged on the twelve o'clock side of the timepiece module 7 and the second antenna 16 is arranged on the six o'clock side of the timepiece module 7 opposing the first antenna 15, as shown in FIG. 11. In this embodiment as well, the first antenna 15 and the second antenna 16 are arranged opposing each other within an angle range of about 100 degrees formed by the straight line S1 connecting the twelve o'clock point and the six o'clock point being rotated.

As a result, the first antenna 15 is arranged in an area located from substantially the eleven o'clock portion of the timepiece module 7 to substantially the one o'clock portion via the twelve o'clock portion and the second antenna 16 is arranged in an area located from substantially the five o'clock portion of the timepiece module 7 to substantially the seven o'clock portion via the six o'clock portion, as shown in FIG. 11.

Specifically, the first antenna 15 is arranged in an area between the through hole 18 in the center of the dial plate 8 and an end portion of the dial plate 8 on the twelve o'clock side, as shown in FIG. 11. The center of this first antenna 15 is positioned on a straight line S4 that intersects with the straight line S1 connecting the twelve o'clock portion and the and the six o'clock portion of the dial plate 8 at the center of the dial plate 8 at an angle of about 5 degrees in the clockwise direction.

Also, the second antenna 16 is arranged such that its center is positioned on the straight line S4 passing through the center of the first antenna 15, as shown in FIG. 11. In this embodiment, the second antenna 16 is arranged in the time piece module 7 along the outer periphery of the dial plate 8, with its one end portion corresponding to substantially the five o'clock portion of the dial plate 8 and the other end portion corresponding to substantially the seven o'clock portion of the dial plate 8.

The first sub-display section 21, which displays the mode of a clock function or the temperature or humidity of external environment, includes the first short pointer 21*a*, as with the first embodiment. This first sub-display section 21 is arranged in an area between the through hole 18 in the center of the dial plate 8 and an end portion of the dial plate 8 located on substantially the ten o'clock side, as shown in FIG. 11. The rotation range of the first short pointer 21*a* of the first sub-display section 21 is set to a predetermined angle range, such as an angle range of about 180 to 300 degrees. In this third embodiment as well, the rotation range is set to an angle range of around 250 degrees.

Also, the second sub-display section 22, which displays the time of each city in the world, includes the two second short pointers 22*a* and 22*b*, as with the first embodiment. This second sub-display section 22 is arranged in an area between the through hole 18 in the center of the dial plate 8 and an end portion of the dial plate 8 on the three o'clock side, and the second short pointers 22*a* and 22*b* thereof rotate by 360 degrees, respectively, as shown in FIG. 11.

Moreover, the third sub-display section 23, which displays a time such as the time of an alarm or a timer, includes the third short pointer 23*a*, as with the first embodiment. This third sub-display section 23 is arranged in an area between the through hole 18 in the center of the dial plate 8 and an end portion of the dial plate 8 on the six o'clock side, and the third short pointer 23*a* thereof rotates by 360 degrees, as shown in FIG. 11.

Also, the first antenna 15 is structured such that its antenna field has a substantially square shape; its side portion on the outer periphery side of the timepiece module 7 is positioned between an area around the eleven o'clock point and an area around the one o'clock point; one corner 15*a* of the corners 15*a* and 15*b* at the sides of its side portion near the through hole 18 in the center of the timepiece module 7 projects into and overlaps with the area of the first sub-display section 21; and the other corner 15*b* is arranged close to the second sub-display section 22, as shown in FIG. 11.

The second antenna 16 is structured such that its center is positioned on the straight line S4 passing through the center of the first antenna 15, as shown in FIG. 11. This second antenna 16 is arranged in the time piece module 7 along the outer periphery of the dial plate 8, with its one end portion corresponding to substantially the five o'clock portion of the dial plate 8 and the other end portion corresponding to substantially the seven o'clock portion of the dial plate 8.

In this embodiment as well, the second antenna 16 is arranged such that the third sub-display section 23 is positioned close thereto or slightly overlaps therewith, whereby the reception performance of the second antenna 16 is hardly affected by the third short pointer 23*a* of the third sub-display section 23 when the second antenna 16 receives a long wave such as a standard time radio wave.

With this wristwatch of the third embodiment, a high-frequency radio wave for GPS can be received by the first antenna 15 arranged in one end portion of the timepiece module 7, and a standard time radio wave which is a long wave and has a frequency differing from that of the high-frequency radio wave for GPS can be received by the second antenna 16 arranged in the other end portion of the timepiece module 7 opposing the first antenna 15, as in the case of the first embodiment. That is, radio waves having different frequencies can be favorably received by the first antenna 15 and the second antenna 16.

In this embodiment as well, the first antenna 15 and the second antenna 16 have been arranged opposing each other within an angle range of about 100 degrees formed by the straight line S1 connecting the twelve o'clock point and the six o'clock point being rotated. Accordingly, if the six o'clock side of the wristwatch case 1 is positioned on the user's body side and the twelve o'clock side thereof is positioned on the side opposite to the user's body side when the wristwatch worn on a wrist is used, the twelve o'clock side of the wristwatch case 1 is positioned away from the user's body and exposed, whereby the first antenna 15 and the second antenna 16 can favorably receive radio waves having different frequencies from the twelve o'clock side positioned away from the user's body.

That is, since the first antenna 15 has been arranged in an area located from substantially the eleven o'clock portion of the timepiece module 7 to substantially the one o'clock portion via the twelve o'clock portion and the second antenna 16 has been arranged in an area located from substantially the five o'clock portion of the timepiece module 7 to substantially the seven o'clock portion via the six o'clock portion, high-frequency radio waves for GPS can be favorably received from the twelve o'clock side of the wristwatch case 1 by the first antenna 15 and standard time radio waves that are long waves can be favorably received from the twelve o'clock side of the wristwatch case 1 by the second antenna 16.

In this embodiment, although one corner 15*a* of the corners 15*a* and 15*b* at the sides of the side portion of the first antenna 15 near the through hole 18 in the center of the timepiece module 7 has projected into and overlapped with the area of the first sub-display section 21, the reception performance of the first antenna 15 is not degraded by the first short pointer 21*a* because the first short pointer 21*a* of the first sub-display section 21 is not moved above the first antenna 15.

In addition, although the other corner 15*b* of the corners 15*a* and 15*b* of the side portion of the first antenna 15 near the through hole 18 in the center of the timepiece module 7 has been arranged close to the area of the second sub-display section 22, the reception performance of the first antenna 15 is hardly affected by the two second short pointers 22*a* and 22*b*, whereby high-frequency radio waves for GPS are favorably received by the first antenna 15.

Also, since the second antenna 16 has been arranged such that the third sub-display section 23 is positioned close thereto or slightly overlaps therewith, the reception performance of the second antenna 16 is not degraded by the third short pointer 23*a* of the third sub-display section 23, whereby the second antenna 16 can favorably receive long waves such as standard time radio waves.

Fourth Embodiment

Next, a third embodiment in which the present invention has been applied in a pointer type wristwatch is described with reference to FIG. 12. In this embodiment as well, sections identical to those in the first embodiment shown in FIG. 1 to FIG. 6 are provided with the same reference numerals.

The structure of this wristwatch of the fourth embodiment is the same as that of the first embodiment except the arrangement positions of the first antenna 15 and the second antenna 16 and the arrangement positions of the first sub-display section 21, the second sub-display section 22, and the third sub-display section 23.

Figure 12:
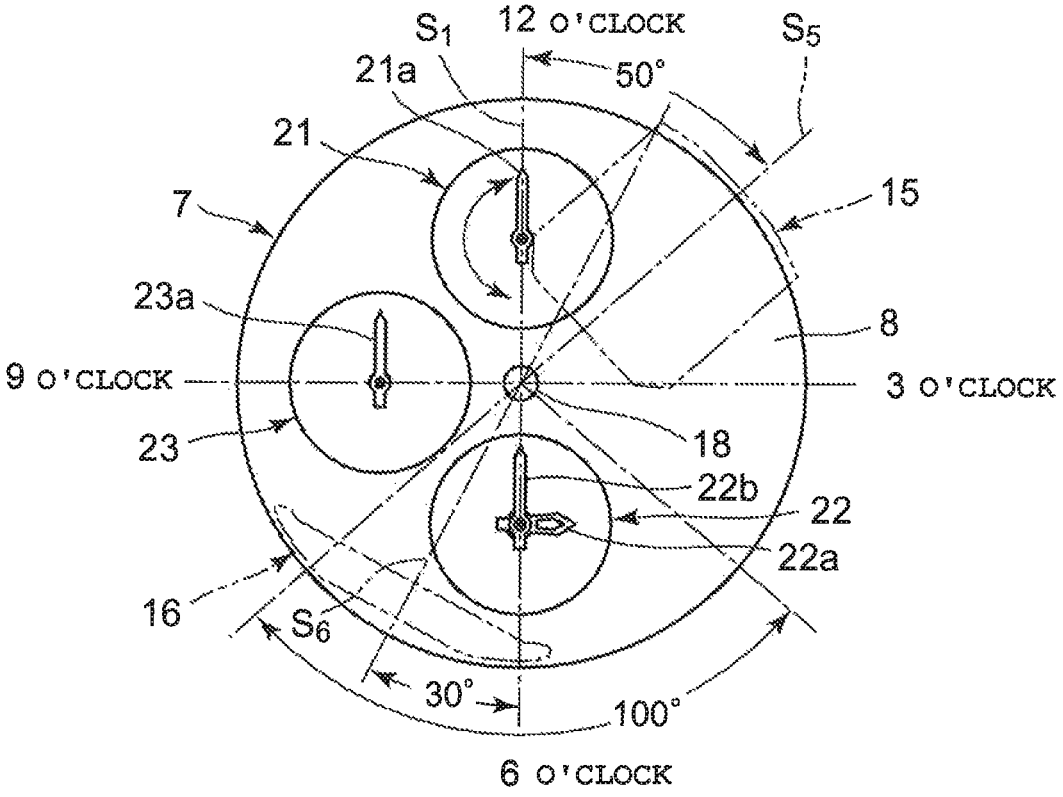
FIG. 12 is an enlarged front view of a timepiece module in a fourth embodiment where the present invention has been applied in a pointer type wristwatch, in which a dial plate has been arranged above the timepiece module.

Specifically, the first antenna 15 is arranged on substantially the two o'clock side of the timepiece module 7 and the second antenna 16 is arranged on substantially the seven o'clock side of the timepiece module 7 opposing the first antenna 15, as shown in FIG. 12. In this embodiment, the first antenna 15 and the second antenna 16 are not positioned on the same line but are positioned on straight lines S5 and S6 tilted at different angles with respect to the straight line S1 connecting the twelve o'clock point and the six o'clock point, respectively.

In this embodiment as well, the first antenna 15 and second antenna 16 are arranged opposing each other within an angle range of about 100 degrees formed by the straight line S1 connecting the twelve o'clock point and the six o'clock point being rotated. That is, the center of the first antenna 15 is positioned on the straight line S5 that intersects with the straight line S1 connecting the twelve o'clock portion and the and the six o'clock portion of the dial plate 8 at the center of the dial plate 8 at an angle of about 50 degrees in the clockwise direction. As a result, the first antenna 15 is arranged between an area around the one o'clock portion of the timepiece module and an area around the two o'clock portion.

Also, the center of the second antenna 16 is positioned on the straight line S6 that intersects with the straight line S1 connecting the twelve o'clock portion and the and the six o'clock portion of the dial plate 8 at the center of the dial plate 8 at an angle of about 30 degrees in the clockwise direction. As a result, the second antenna 16 is arranged in the time piece module 7 along the outer periphery of the dial plate 8, with its one end portion corresponding to an area around the six o'clock portion of the dial plate 8 and the other end portion corresponding to an area around the eight o'clock portion of the dial plate 8.

The first sub-display section 21, which displays the mode of a clock function or the temperature or humidity of external environment, includes the first short pointer 21*a*, as with the first embodiment. This first sub-display section 21 is arranged in an area between the through hole 18 in the center of the dial plate 8 and an end portion of the dial plate 8 on the twelve o'clock side, as shown in FIG. 12. The rotation range of the first short pointer 21*a* of the first sub-display section 21 is set to a predetermined angle range, such as an angle range of about 180 to 300 degrees. In this fourth embodiment, the rotation range is set to an angle range of around 180 degrees.

Also, the second sub-display section 22, which displays the time of each city in the world, includes the two second short pointers 22*a* and 22*b*, as with the first embodiment. This second sub-display section 22 is arranged in an area between the through hole 18 in the center of the dial plate 8 and an end portion of the dial plate 8 on the six o'clock side, and the second short pointers 22*a* and 22*b* thereof rotate by 360 degrees, respectively, as shown in FIG. 12.

Moreover, the third sub-display section 23, which displays a time such as the time of an alarm or a timer, includes the third short pointer 23*a*, as with the first embodiment. This third sub-display section 23 is arranged in an area between the through hole 18 in the center of the dial plate 8 and an end portion of the dial plate 8 on the nine o'clock side, and the third short pointer 23*a* thereof rotates by 360 degrees, as shown in FIG. 12.

Also, the first antenna 15 is structured such that its antenna field has a substantially square shape; its side portion on the outer periphery side of the timepiece module 7 is positioned between an area around the one o'clock point and an area around the two o'clock point; one corner 15*a* of the corners 15*a* and 15*b* at the sides of its side portion near the through hole 18 in the center of the timepiece module 7 projects into and overlaps with the area of the first sub-display section 21; and the other corner 15*b* is positioned away from the second sub-display section 22, as shown in FIG. 12.

The second antenna 16 is arranged such that the second sub-display section 22 is positioned close thereto and does not overlap therewith, as shown in FIG. 12. As a result, the reception performance of the second antenna 16 is not affected by the second short pointers 22*a* and 22*b* of the second sub-display section 22 when the second antenna 16 receives a long wave such as a standard time radio wave.

With this wristwatch of the fourth embodiment, a high-frequency radio wave for GPS can be received by the first antenna 15 arranged in one end portion of the timepiece module 7, and a standard time radio wave which is a long wave and has a frequency differing from that of the high-frequency radio wave for GPS can be received by the second antenna 16 arranged in the other end portion of the timepiece module 7 opposing the first antenna 15, as in the case of the first embodiment. That is, radio waves having different frequencies can be unfailingly and favorably received by the first antenna 15 and the second antenna 16.

In this embodiment as well, the first antenna 15 and second antenna 16 have been arranged opposing each other within an angle range of about 100 degrees formed by the straight line S1 connecting the twelve o'clock point and the six o'clock point being rotated. Accordingly, if the six o'clock side of the wristwatch case 1 is positioned on the user's body side and the twelve o'clock side thereof is positioned on the side opposite to the user's body side when the wristwatch worn on a wrist is used, the twelve o'clock side of the wristwatch case 1 is positioned away from the user's body and exposed, whereby the first antenna 15 and the second antenna 16 can favorably receive radio waves having different frequencies from the twelve o'clock side positioned away from the user's body.

That is, since the first antenna 15 has been arranged in an area located from substantially the one o'clock portion of the timepiece module 7 to substantially the two a' clock portion and the second antenna 16 has been arranged in an area located from substantially the six o'clock portion of the timepiece module 7 to substantially the eight o'clock portion, high-frequency radio waves for GPS can be favorably received from the twelve o'clock side of the wristwatch case 1 by the first antenna 15 and standard time radio waves that are long waves can be favorably received from the twelve o'clock side of the wristwatch case 1 by the second antenna 16.

In this embodiment, although one corner 15*a* of the corners 15*a* and 15*b* at the sides of the side portion of the first antenna 15 near the through hole 18 in the center of the timepiece module 7 has projected into and overlapped with the area of the first sub-display section 21, the reception performance of the first antenna 15 is not degraded by the first short pointer 21*a* because the first short pointer 21*a* of the first sub-display section 21 is not moved above the first antenna 15.

Also, since the second antenna 16 has been arranged such that the second sub-display section 22 is positioned close thereto and does not overlap therewith, the reception performance of the second antenna 16 is not degraded by the second short pointers 22*a* and 22*b* of the second sub-display section 22, whereby the second antenna 16 can favorably receive long waves such as standard time radio waves.

Note that, although the first to third sub-display sections 21 to 23 have been included in the above-described first to fourth embodiments and the modification examples, the present invention is not limited thereto, and a structure including one, two, four, or more sub-display sections or a structure that does not include sub-display sections may be adopted.

Also, in the above-described first to fourth embodiments and the modification examples, the pointers 20 including the hour hand, the minute hand, and the second hand, the first short pointer 21*a*, the two second short pointers 22*a* and 22*b*, and the third short pointer 23*a* are made of a metallic material. However, the present invention is not limited thereto, and they may be made of a resin material or a carbon material.

Moreover, in the above-described first to fourth embodiments and the modification examples, the first non-power-generation section 26 provided in the solar panel 9 and corresponding to the first antenna 15 and the second non-power-generation section 27 provided in the solar panel 9 and corresponding to the second antenna 16 have been formed by portions of the solar panel 9 being cut off. However, the present invention is not limited thereto. For example, the first non-power-generation section 26 and the second non-power-generation section 27 may be formed by portions of the lower electrodes, the semiconductor layers, and the upper electrodes being cut off such that the film substrate remains uncut.

Furthermore, although the first non-power-generation section 26 provided in the solar panel 9 and corresponding to the first antenna 15 in the above-described first to fourth embodiments and the modification examples has been formed by a portion of the solar panel 9 being cut off, the present invention is not limited thereto, and the first non-power-generation section 26 may be formed by portions of the lower electrodes, the semiconductor layers, and the upper electrodes corresponding to the outer shape of the emitting electrode of the first antenna 15 being cut off without a portion of the film substrate corresponding thereto being cut off. In addition, although it may slightly affect the reception performance, a cell 9*a* around which an area corresponding to the outer shape of the emitting electrode has been cut off may be connected to other plurality of cells 9*a* in series by a connection section being provided.

Still further, in the above-described first to fourth embodiments and the modification examples, the present invention has been applied to a pointer type wristwatch. However, the present invention is not necessarily applied to a wristwatch. The present invention can be applied to various pointer-type timepieces, such as a travel watch, an alarm clock, a table clock, and a wall clock. In addition, the present invention is not necessarily applied to a timepiece, and can be applied to electronic devices, such as a mobile phone and a portable information terminal device.

While the present invention has been described with reference to the preferred embodiments, it is intended that the invention be not limited by any of the details of the description therein but includes all the embodiments which fall within the scope of the appended claims.

What is claimed is:

1. An electronic device comprising:

a case;

a dial plate provided in the case;

a module arranged below the dial plate;

a first antenna arranged in an end portion of the module; and a second antenna arranged in another end portion of the module so as to receive a radio wave having a frequency differing from a frequency of a radio wave to be received by the first antenna, wherein the second antenna is arranged on an extended line which extends a straight line connecting a center of the first antenna and a through hole provided in a center portion of the dial plate, from the center of the first antenna toward the through hole.

2. The electronic device according to claim 1, wherein the module includes a pointer shaft inserted into the through hole.

3. The electronic device according to claim 2, wherein the dial plate is made of a light transmissive material, and a solar panel which receives extraneous light and generates electricity is arranged between the dial plate and the module.

4. The electronic device according to claim 3, wherein a non-power generation section is provided in the solar panel in an area which corresponds to an area of at least an upper portion of the first antenna.

5. The electronic device according to claim 4, wherein the dial plate has a pattern that is line-symmetric with respect to a straight line connecting a twelve o'clock point and a six o'clock point, and wherein a boundary line between the solar panel and the non-power-generation section is tilted at a predetermined angle with respect to the pattern.

6. The electronic device according to claim 5, wherein the pattern is cyclically formed at predetermined intervals.

7. The electronic device according to claim 2, wherein a first sub-display section having one short pointer and a second sub-display section having two short pointers are arranged to sides of the first antenna, and wherein the first sub-display section is positioned closer to the first antenna than the second sub-display section, and the first antenna is positioned close to an axis of the short pointer of the first sub-display section.

8. The electronic device according to claim 3, wherein a first sub-display section having one short pointer and a second sub-display section having two short pointers are arranged to sides of the first antenna, and wherein the first sub-display section is positioned closer to the first antenna than the second sub-display section, and the first antenna is positioned close to an axis of the short pointer of the first sub-display section.

9. The electronic device according to claim 4, wherein a first sub-display section having one short pointer and a second sub-display section having two short pointers are arranged to sides of the first antenna, and wherein the first sub-display section is positioned closer to the first antenna than the second sub-display section, and the first antenna is positioned close to an axis of the short pointer of the first sub-display section.

10. The electronic device according to claim 1, wherein the dial plate is made of a light transmissive material, and a solar panel which receives extraneous light and generates electricity is arranged between the dial plate and the module.

11. The electronic device according to claim 10, wherein a non-power generation section is provided in the solar panel corresponding to in an area which corresponds to an area of at least an upper portion of the first antenna.

12. The electronic device according to claim 11, wherein the dial plate has a pattern that is line-symmetric with respect to a straight line connecting a twelve o'clock point and a six o'clock point, and wherein a boundary line between the solar panel and the non-power-generation section is tilted at a predetermined angle with respect to the pattern.

13. The electronic device according to claim 12, wherein the pattern is cyclically formed at predetermined intervals.

14. The electronic device according to claim 13, wherein a first sub-display section having one short pointer and a second sub-display section having two short pointers are arranged to sides of the first antenna, and wherein the first sub-display section is positioned closer to the first antenna than the second sub-display section, and the first antenna is positioned close to an axis of the short pointer of the first sub-display section.

15. The electronic device according to claim 10, wherein a first sub-display section having one short pointer and a second sub-display section having two short pointers are arranged to sides of the first antenna, and wherein the first sub-display section is positioned closer to the first antenna than the second sub-display section, and the first antenna is positioned close to an axis of the short pointer of the first sub-display section.

16. The electronic device according to claim 11, wherein a first sub-display section having one short pointer and a second sub-display section having two short pointers are arranged to sides of the first antenna, and wherein the first sub-display section is positioned closer to the first antenna than the second sub-display section, and the first antenna is positioned close to an axis of the short pointer of the first sub-display section.

17. The electronic device according to claim 12, wherein a first sub-display section having one short pointer and a second sub-display section having two short pointers are arranged to sides of the first antenna, and wherein the first sub-display section is positioned closer to the first antenna than the second sub-display section, and the first antenna is positioned close to an axis of the short pointer of the first sub-display section.

18. The electronic device according to claim 1, wherein a first sub-display section having one short pointer and a second sub-display section having two short pointers are arranged to sides of the first antenna, and wherein the first sub-display section is positioned closer to the first antenna than the second sub-display section, and the first antenna is positioned close to an axis of the short pointer of the first sub-display section.

19. The electronic device according to claim 1, wherein the dial plate comprises time indicator marks indicating the time;

wherein the first antenna is arranged in an area located from around a time indicator mark indicating four o'clock via a time indicator mark indicating five o'clock to around a time indicator mark indicating six o'clock, and wherein the second antenna is arranged in an area located from around a time indicator mark indicating ten o'clock via a time indicator mark indicating eleven o'clock to around a time indicator mark indicating twelve o'clock.

20. The electronic device according to claim 1, wherein a center of the second antenna is arranged on the extended line which extends the straight line connecting the center of the first antenna and the through hole provided in the center portion of the dial plate, from the center of the first antenna toward the through hole.

21. The electronic device according to claim 1, wherein a portion of the second antenna is arranged along a portion of said another end portion which is located within a range of 100 degrees centering on the through hole and a middle of which is located on an intersection of a straight line connecting a twelve o'clock point and a six o'clock point and said another end portion of the timepiece module.

22. The electronic device according to claim 1, wherein the first antenna receives an Ultra High Frequency band, and wherein the second antenna receives a Low Frequency band.

23. A wristwatch comprising:

a wristwatch case;

a dial plate provided in the wristwatch case;

a timepiece module arranged below the dial plate;

a first antenna arranged in an end portion of the timepiece module; and a second antenna arranged in another end portion of the timepiece module so as to receive a radio wave having a frequency differing from a frequency of a radio wave to be received by the first antenna, wherein the second antenna is arranged on an extended line which extends a straight line connecting a center of the first antenna and a through hole provided in a center portion of the dial plate, from the center of the first antenna toward the through hole.

* * * * *